United States Patent [19]

Hayes et al.

[11] Patent Number: 4,472,479

[45] Date of Patent: Sep. 18, 1984

[54] LIGHT BARRIER FLUORESCENT RIBBON

[75] Inventors: Larry J. Hayes, Roanoke; Keith L. Reddick, Dallas, both of Tex.

[73] Assignee: Recognition Equipment Incorporated, Irving, Tex.

[21] Appl. No.: 506,582

[22] Filed: Jun. 22, 1983

Related U.S. Application Data

[63] Continuation of Ser. No. 291,194, Aug. 10, 1981, abandoned, which is a continuation-in-part of Ser. No. 101,407, Dec. 10, 1979, abandoned.

[51] Int. Cl.[3] ..... B41M 3/14; B41M 5/02

[52] U.S. Cl. ..... 428/324; 400/241; 400/241.4; 427/146; 427/152; 427/153; 427/157; 427/162; 428/204; 428/207; 428/208; 428/323; 428/328; 428/480; 428/484; 428/488.4; 428/690; 428/914

[58] Field of Search ..... 8/648; 106/23, 31; 427/54.1, 146, 152, 160, 162, 404, 153, 157, 164; 428/207, 208, 323, 328, 336, 339, 484, 488, 913, 914, 324, 690, 204, 209, 480, 403; 400/237, 241, 241.1, 241.2, 241.4

[56] References Cited

U.S. PATENT DOCUMENTS

| | | | |
|---|---|---|---|
| 3,057,806 | 10/1962 | Suitzer | 252/301.35 |
| 3,607,344 | 9/1971 | Baumann et al. | 428/913 |
| 4,146,403 | 3/1979 | Armanini | 428/363 |
| 4,192,691 | 3/1980 | Armanini | 428/363 |
| 4,307,149 | 12/1981 | Scott et al. | 428/207 |

FOREIGN PATENT DOCUMENTS

| | | | |
|---|---|---|---|
| 1036743 | 7/1966 | United Kingdom | 428/914 |

*Primary Examiner*—Bruce H. Hess

*Attorney, Agent, or Firm*—Richards, Harris & Medlock

[57] ABSTRACT

A barrier pigment is added to a fluorescent ribbon to prevent light from being absorbed into the media upon which the pigment is applied during printing. The barrier pigment is added to the fluorescent layer or is applied over the fluorescent layer as an additional layer.

12 Claims, 10 Drawing Figures

EXAMPLES OF RIBBON COATINGS

| EXAMPLE NO. | LAYER NO. | CONTENT |
|---|---|---|
| 1 | b | FLUORESCENT RESIN-DYE MIXTURES AND WAXES (PRIOR ART) |
| 2 | b<br>c | FLUORESCENT RESIN-DYE MIXTURES AND WAXES<br>WAXES CONTAINING 0.1-5% MEARLIN COPPER AND /OR MEARLIN SUPERFINE |
| 3 | b<br>c | FLUORESCENT RESIN-DYE MIXTURES AND WAXES<br>WAXES CONTAINING 0.1-3% MEARLIN ANTIQUE GOLD |
| 4 | b<br>c | FLUORESCENT RESIN-DYES AND WAXES<br>WAXES CONTAINING 0.1-5% MEARLIN PIGMENTS AS IN EXAMPLES 1-3 |

TABLE 1

EXAMPLES OF RIBBON COATINGS

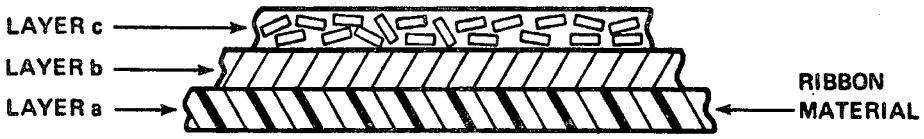

| EXAMPLE NO. | LAYER NO. | CONTENT |
|---|---|---|
| 1 | b | FLUORESCENT RESIN-DYE MIXTURES AND WAXES (PRIOR ART) |
| 2 | b<br>c | FLUORESCENT RESIN-DYE MIXTURES AND WAXES<br>WAXES CONTAINING 0.1-5% MEARLIN COPPER AND /OR MEARLIN SUPERFINE |
| 3 | b<br>c | FLUORESCENT RESIN-DYE MIXTURES AND WAXES<br>WAXES CONTAINING 0.1-3% MEARLIN ANTIQUE GOLD |
| 4 | b<br>c | FLUORESCENT RESIN-DYES AND WAXES<br>WAXES CONTAINING 0.1-5% MEARLIN PIGMENTS AS IN EXAMPLES 1-3 |

TABLE 2

COMPARATIVE RIBBON IMPRINT FLUORESCENT RESPONSE

| PEAK HEIGHT OF FLUORESCENT RESPONSE IN MILLIVOLTS | | | | |
|---|---|---|---|---|
| SAMPLE IMPRINT | BACKGROUND → | WHITE | BLACK | RATIO WHITE:BLACK |
| WITHOUT MEARLIN BARRIER COAT PIGMENTS | | 554 | 25 | 22:1 |
| WITH MEARLIN SUPERFINE | | 508 | 42 | 12:1 |
| WITH MEARLIN COPPER PIGMENT | | 462 | 38 | 12:1 |

LIGHT BARRIER FLUORESCENT RIBBON

This application is a continuation of application Ser. No. 291,194 filed Aug. 10, 1981, now abandoned, which in turn application Ser. No. 101,407, filed Dec. 10, 1979, entitled "Light Barrier Fluorescent Ribbon", now abandoned.

FIELD OF INVENTION

This invention relates to fluorescent printing ribbons and more particularly to a ribbon which has reflective pigments therein, to prevent penetration of incident light into the surface on which an imprint has been made.

BACKGROUND OF INVENTION

Fluorescent ribbons are generally employed to allow the coding of documents which can subsequently be read electronically (optically) in order to allow machine sorting of the documents.

The preparation of the ribbon with transferrable fluorescent material is accomplished by depositing a layer of fluorescent material and waxes on the surface of a thin film of plastic. Thin plastic film materials most often used as ribbon carriers are polyethylene or Mylar.

The waxy fluorescent material transfer to the printing surface is very thin and transparent to visual observation. This transparency of the imprinted fluorescent material on paper becomes a problem where the imprintation is over a darker colored portion of paper.

Daylight fluorescent materials can be viewed when excited by sunlight. Daylight fluorescent materials are transparent or translucent in nature and therefore applied over white primer inorder to obtain the maximum daylight fluorescent effect. The addition of the white opaque pigment in the formulation does not serve to enhance the fluorescence but rather reduce it to a tint and possibly may therefore reduce light fastness.

When a fluorescent material is deposited upon the surface of white paper the whiteness of the paper serves as a light reflector. The incident light passes through the pigments and penetrates the paper base to a slight degree depending upon the whiteness of the paper. Most of the incident light reflects off the paper and back through the fluorescent material imprinted on the paper. The reflected light will contain both incident and fluorescent light.

If the fluorescent material is deposited on the surface of a dark colored paper, part of the incident light will be absorbed by the paper. The amount of light available for reflection back through the fluorescent material is reduced proportional to the amount of light absorbed by the paper. This reduction in light reflection by the paper will lower the amount of energy available to produce emission from the fluorescent material.

SUMMARY OF THE INVENTION

This invention relates to an imprint ribbon having a coating thereon that will reduce the fluorescent intensity differences due to the type of back to which it is applied and a method of preparing the material. Greater accuracy is accomplished in electronic (optical) reading of a signal produced by an emitted light from the fluorescent pigment. To prepare the ribbon, a layer of wax or other suitable medium and fluorescent material is deposited on the ribbon base and a reflective barrier material is added to this layer or deposited in a second layer of wax upon the first layer. The barrier pigments used are pigments of finely divided metals or materials with metallic colors which are reflective and do not shift the wave length of the fluorescent light.

The objects, features, advantages and technical advance of the invention will be apparent from the following more detailed descriptions of preferred embodiments of the invention as illustrated in accompanying drawings.

Table 1 lists the layers used in making a ribbon of the present invention as set forth in the examples.

Table 2 is a comparative ribbon imprint fluorescent response.

DESCRIPTION OF PREFERRED EMBODIMENTS OF THE INVENTION

In describing preferred embodiments of the invention a review of the prior art ribbons will help in understanding the improvements and technical advance represented by this invention. Prior ribbons as illusted in FIG. 1 are made by depositing a layer of fluorescent material and waxes on the surface of a thin film of plastic, for example, polyethlene or Mylar.

Figure 1:
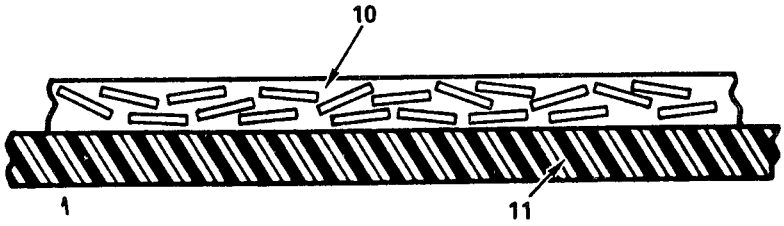
FIG. 1 illustrates a prior art fluorescent ribbon configuration.
Figure 2:
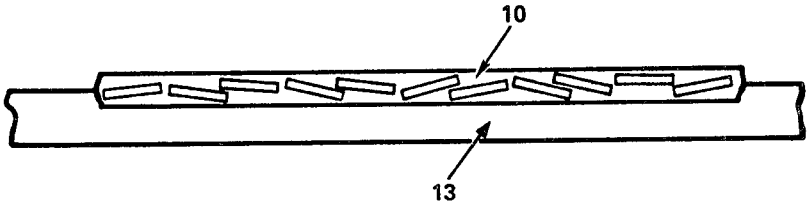
FIG. 2 illustrates an imprint of the fluorescent wax and resin on paper.

Using the ribbon of FIG. 1, the waxy fluorescent material transfers from the ribbon to the paper surface as shown in FIG. 2. The wax and resin layer 10 on the ribbon base 11 transfers and adheres to the paper stock 13.

Figure 3:
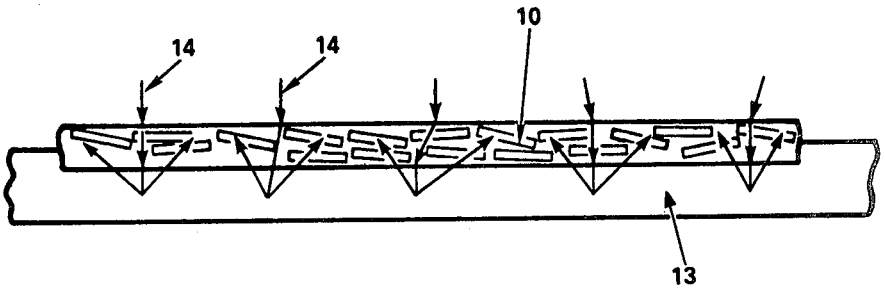
FIG. 3 illustrates the behavior of light which passes through the transparent wax and resin mixture imprinted on paper.

When a fluorescent material is deposited on a surface of white paper the whiteness of the paper serves as a reflector. The incident light 14 passes through the pigments as shown in FIG. 3 and penetrates the paper base to a slight degree depending on the whiteness of the paper. Most of the incident light reflects off the paper and back through the fluorescent material. The reflected light will contain both incident light and fluorescent light.

Figure 7:
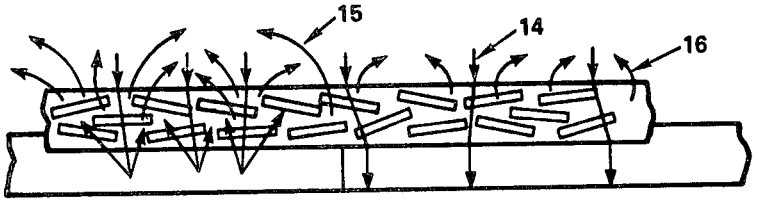
FIG. 7 illustrates light behavior on fluorescent materials imprinted on colored paper.

If the fluorescent materials are deposited on the surface of a light and dark colored paper, as shown in FIG. 7, the amount of light available for reflection back to the fluorescent material will be reduced in proportion to the amount of light absorbed by the paper. The reduction in light reflected from the paper, due to absorption, will lower the amount of energy available to produce emission from the fluorescent material. As illustrated in FIG. 7, incident light 14 is absorbed in the dark colored paper, but penetrates only slightly in the light colored paper. Since penetration is less in the light colored area, more of the incidentlight is reflected back through the fluorescent material. Fluorescent emission 15 from the imprint on the light colored paper is much greater than the fluorescent emission 16 from the material imprinted on the dark colored paper.

Figure 4:
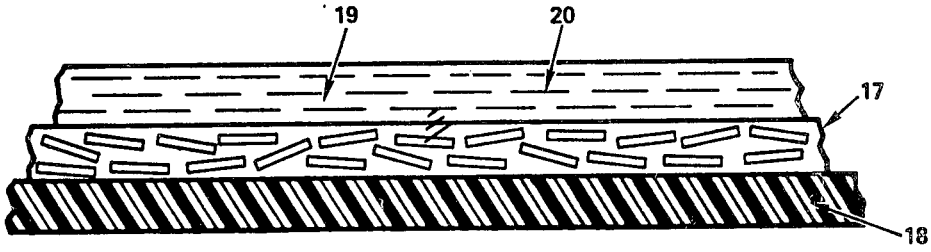
FIG. 4 illustrates a ribbon of the present invention with a top coated barrier layer.
Figure 5:
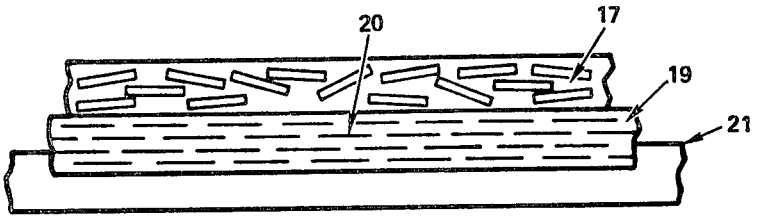
FIG. 5 illustrates an imprint of the present invention upon paper.

A ribbon of the present invention is illustrated in FIG. 4 wherein the wax and fluorescent resin 17 is applied to a ribbon base 18. Thereafter a second medium layer 19, such as wax, having barrier coat pigments 20 therein is applied over the first wax in the fluorescent layer. When an imprint is made from the ribbon the result is illustrated in FIG. 5 wherein the paper 21 has both the wax layer 17 and wax layer 19 thereon. The order of layers is reversed when ribbon layers are transferred to paper. When deposited on paper, the wax layer and the barrier coat pigment 20 is now in contact with the paper 21 and the wax and fluorescent material layer 17 is not in direct contact with the paper. In the present invention the fluorescent ribbon coating will reduce the fluorescent intensity differences due to the type of background to which it is applied. This will allow a greater accuracy in reading of optical signals produced by the emitted light from the fluorescent material. The primary layer of wax and fluorescent material are deposited on the ribbon material then the second layer of wax including a barrier pigment is deposited upon the primary layer.

Figure 6:
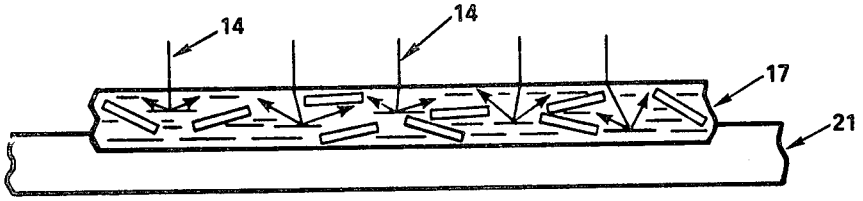
FIG. 6 illustrates an embodiment of the invention where the barrier pigment is incorporated into the fluorescent layer.

FIG. 6 illustrates an embodiment of the invention wherein the barrier material 20 is incorporated into the fluorescent layer 17. Example 5, set forth below, describes such an embodiment.

The barrier materials used in the formulation of the overcoat layer should not be opaque dyes, or minerals such as finely ground silica, alumina, or titanium oxide. Pigments tend to blend with fluorescent dyes on impact and thereby reduce the intensity of fluorescent emission. Pigments or dyes can shift the wave length of fluorescent light.

The pigments of the present invention are finely divided pigments of reflective material which do not reshift the wave length of fluorescent light. Examples of such pigments are manufactured by the Mearl Corporation and are sold under the trade name of Mearlin luster pigments. The Mearlin luster pigments include Antique Gold, Golden Bronze, Antique Bronze, Copper and Antique Copper. The Mearlin pigments are nacreous pigments consisting of mica platelets coated with titanium oxide and/or iron oxide. All nacreous pigments contain transparent platelets of high refractive index.

The fluorescent material used in the ribbon of the present invention is a mixture of fluorescent dyes suspended in a solid polyester resin. The color of the resin material is dependent upon the particular fluorescent dye chosen. The resin material of the present invention is of an orange color. Normally a dye that emits within the desired wave length being optically monitored is selected. A ribbon prepared with the fluorescent material produces a strong fluorescent when viewed under ultraviolet or blue light. The fluorescence is easily observed when a waxy material is imprinted on white or lght colored paper and viewed under blue light.

The imprinted mark of the orange dyes has been found to be difficult to see in normal lighting. The addition of a dye such as CI Basic Violet 10 also known as Rhodamine B Extra that increases the visual detection without significantly reducing the fluorescent intensity, is desired.

The fluorescent layer is transparent. If a dark or red colored pigment, which is reflective, were added to the second or barrier layer the visual appearance of the imprinted material would be darker or redder without interferring sufficiently with fluorescent response of the orange fluorescence emission. The Mearlin pigments provide the opacity and color to permit formulation of an effective barrier coat layer.

Figure 8:
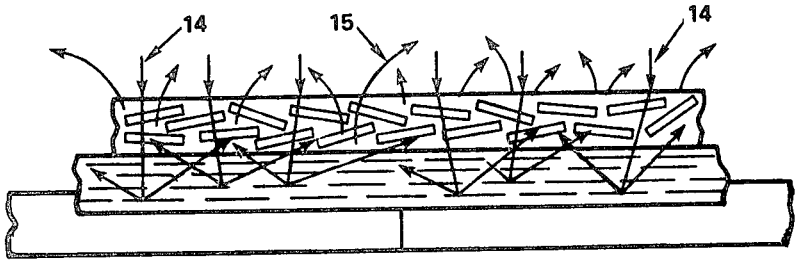
FIG. 8 illustrates light behavior on the fluorescent materials when underlain with a barrier coating imprinted on dark and light papers.

FIG. 8 illustrates the light behavior of fluorescent materials when the barrier layer is used. The addition of the reflective pigment serves as a barrier, preventing penetration of the incident light into the paper upon which imprintation had been made. In FIG. 8 examples are shown using both the light colored paper and dark colored paper. The incident light 14 penetrates the fluorescent layer passing therethrough and penetrates slightly the barrier layer of the present invention. The light is reflected back into the fluorescent layer whereas the emission of the coating on the light colored paper is the same as the emission from the dark colored paper. Since the transmission of light through the transparent waxy deposit to the paper has been reduced by the addition of the metallic pigment or mixtures of metallic pigments, a more uniform fluorescent emission will be obtained. More light energy will be present to react with the fluorescent pigment so that the difference between light and dark colored backgrounds is minimized.

The following examples are given of mixtures which may be used in preparing ribbons of the present invention.

EXAMPLE 1

A polyester resin such as described by Broadhead (U.S. Pat. No. 3,053,783) or Thomas (U.S. Pat. No. 4,024,111) can be used as the resin for suspending the fluorescent dyes such as Basic Yellow I, Basic Violet 10, Basic Red 1, Basic Yellow 40, or other appropriate fluorescent dyes. The fluorescent dyes are normally added during the synthesis of the polyester resin to ensure uniform distribution of the fluorescent dyes in the resin.

The resin was cooled overnight and ground into a fine powder. The powdered resin was blended with waxes to form a single layer coating on polyethylene film.

EXAMPLE 2

The powdered resin as described in Example 1 was blended with waxes to form a single layer coating on polyethylene film. A second layer containing waxes and Mearlin pigments as described in Table 1 was placed on the ribbon.

Ribbon coatings from Examples 2 to 3 were imprinted on ink test documents containing a black square surrounded by white. Fluorescent imprints of a common character appearing in both the white and black regions of the list document were examined. The fluorescent signal of this character is presented in Table 2. This signal was scanned over the range of 550 to 700 nanometers.

Alternate ribbon formulations are:

EXAMPLE 3

The powdered resin as described in Example 1 are blended with waxes to form a single layer coating on polyethylene film. A second layer containing waxes and Mearlin Antique Gold as described in Table 1 are deposited above the primary fluorescent layer as a barrier coat layer.

EXAMPLE 4

The powder resin as described in Example 1 is blended with waxes to form a single layer coating on polyethylene film. A second layer containing waxes and Mearlin Golden Bronze, Antique Copper, or Antique Bronze or mixtures thereof are deposited above the primary fluorescent layer as a barrier coat layer.

EXAMPLE 5

A resin melt as described in Example 1 was prepared. After the dyes had been added, known quantities of Mearlin pigments were added to the resin melt. The quantity of Mearlin pigments added to the melt was in increments of 1 to 2 weight percent of final resin-pigment mix. The new melt mixture was mixed for 5 minutes and then decanted into trays for cooling. The resin-pigment material was then ground into a fine powder. Successful single layer ribbons have been prepared using a mixture of waxes and fluorescent resin containing a barrier coating pigment.

EXAMPLE 6

The powdered resin as described in Example 1 was blended with Polywax 500, Be Square 195, Glycomul L, and antioxidant, a binder and aluminum powder to form a single layer coating on polyethylene film. This ribbon product showed 85% of the fluorescence of the same coating without the aluminum powder being added. This is dissolved as a slurry and applied to ribbon base.

EXAMPLE 7

The powdered resin as described 3 Example 1 was blended with Polywax 500, Be Square 195, Glycomul L, an antioxidant, and a binder to form a single layer fluorescent coating on polyethylene film. A second layer containing Polywax 500, Be Square 195, Gylcomul L, an antioxidant, a binder, and aluminum foil were placed on top of the fluorescent material above to form a barrier layer as described in FIG. 4.

Example 6 and 7 are applicable to FIG. 4 wherein the ribbon base 18 has the fluorescent layer 17 thereon. The layer 19 would be the aluminum foil of Example 7 or the aluminum powder would be the barrier pigment 20. Also, the aluminum powder could be mixed in the layer 17 along with the fluorescent mterial to eliminate one of the layers. Table 1 illustrates ribbons of the present invention having two layers of materials thereon wherein the barrier coat is of different pigments.

FIG. 2 is a comparative ribbon imprint fluorescent response illustrating the response for an imprint without a coating and imprints with different coating.

Specific examples have been given for preparing ribbons of the present invention and specific pigments have been named. However pigments other than those named which are reflective in nature may be used. Modifications of mixtures and pigments used within the coatings defined herein may be made without departing from the scope of the invention as defined in the following claims.

What is claimed:

1. An improved fluorescent printing ribbon wherein a transparent fluorescent material forms a layer comprising dyes and one of a wax and a polyester resin and is applied to a ribbon base, the improvement comprising a barrier material of reflective particles included with said layer comprising finely divided material which (a) has a metallic color, (b) is reflective, (c) does not shift the wavelength of fluorescent light and (d) blocks absorption of incident light into the media upon which the fluorescent layer and barrier material are transferred during printing.

2. The ribbon according to claim 1 wherein the barrier material comprises opaque reflective metallic particles.

3. The ribbon according to claim 1 wherein the barrier material is supported in a wax base.

4. An improved flourescent printing ribbon having a ribbon base and a transferable transparent fluorescent layer thereon formed from fluorescent dyes and one of a wax and a polyester resin, the improvement comprising a barrier material comprising finely divided metals or materials with metallic colors which are reflective and do not shift the wavelength of fluorescent light, said barrier material being incorporated into the fluorescent layer to increase the light opacity of the fluorescent layer.

5. A fluorescent printing ribbon comprising a ribbon base, a transferable transparent fluorescent layer of a mixture of wax and fluorescent dye material on said ribbon base and a transferable barrier layer on said fluorescent layer, said barrier layer comprising finely divided materials with metallic colors which are reflective and do not shift the wavelength of fluorescent light.

6. The ribbon according to claim 5 wherein the barrier layer comprises said particles suspended in a wax base.

7. The ribbon according to claim 5 wherein the barrier particles are selected from the group including the colors of gold, bronze, copper, silver and shades of these colors.

8. The ribbon according to claim 5 wherein the barrier particles in the barrier layer are nacreous pigments consisting of mica platelets coated with one of titanium dioxide and iron oxide.

9. The ribbon according to claim 5 wherein the reflective material is aluminum powder.

10. An improved fluorescent printing ribbon wherein a transparent fluorescent material comprising fluorescent dyes is applied to a ribbon base, the improvement comprising a barrier layer of finely divided particles forming an additional layer over the fluorescent material to block absorption of incident light into the media upon which the fluorescent material and the barrier layer are transferred during printing, the barrier layer comprising finely divided particles which are (a) metallic in color, reflective and (c) do not shift the wavelength of fluorescent light.

11. A method of making a barrier coated fluorescent printing ribbon comprising the steps of adhering a transferable transparent fluorescent layer comprising dyes and one of a wax and a polyester resin to a ribbon base and coating said fluorescent layer with a transferable barrier layer of material opaque to light, the transferable barrier layer comprising finely divided particles which are (a) metallic in color, (b) reflective, and (c) do not shift the wavelength of fluorescent light.

12. The method according to claim 11 wherein the barrier layer consists of an opaque reflective material suspended in a medium material.

* * * * *

UNITED STATES PATENT AND TRADEMARK OFFICE

CERTIFICATE OF CORRECTION

PATENT NO. : 4,472,479

DATED : September 18, 1984

INVENTOR(S) : Larry J. Hayes and Keith L. Reddick

It is certified that error appears in the above-identified patent and that said Letters Patent is hereby corrected as shown below:

Column 4, line 54 change "2 to 3" to --2 and 3--.
Column 5, line 17 change "1 to 2" to --1 or 2--.
Column 5, line 36 delete "3" and insert --in-- therefor.

Signed and Sealed this

*Twenty-third* Day of *April 1985*

[SEAL]

*Attest:*

DONALD J. QUIGG

*Attesting Officer* *Acting Commissioner of Patents and Trademarks*